US005708444A

United States Patent [19]

Pouwels et al.

[11] Patent Number: 5,708,444

[45] Date of Patent: Jan. 13, 1998

[54] MULTIPATCH ANTENNA WITH EASE OF MANUFACTURE AND LARGE BANDWIDTH

[75] Inventors: Arthur Johannes Hendrikus Pouwels, Arnhem; Adrianus Bernardus Smolders, Eindhoven, both of Netherlands

[73] Assignees: Hollandse Signaalapparaten B.V., Hengelo; Stichting Voor De Technische Wetenschappen, Utrecht, both of Netherlands

[21] Appl. No.: 615,289

[22] PCT Filed: Sep. 27, 1994

[86] PCT No.: PCT/EP94/03232

§ 371 Date: Mar. 28, 1996

§ 102(e) Date: Mar. 28, 1996

[87] PCT Pub. No.: WO95/09455

PCT Pub. Date: Apr. 6, 1995

[30] Foreign Application Priority Data

Sep. 29, 1993 [NL] Netherlands ..... 9301677

[51] Int. Cl.[6] ..... H01Q 1/38

[52] U.S. Cl. ..... 343/700 MS; 343/829; 343/846

[58] Field of Search ..... 343/700 MS, 850, 343/852, 853, 857, 858, 829, 830, 846, 848; H01Q 1/38

[56] References Cited

U.S. PATENT DOCUMENTS 5,006,859 4/1991 Wong et al. ..... 343/700 MS
5,497,164 3/1996 Croq ..... 343/700 MS

FOREIGN PATENT DOCUMENTS 58-59605 4/1983 Japan ..... 343/700 MS

*Primary Examiner*—Hoanganh T. Le
*Attorney, Agent, or Firm*—Oblon, Spivak, McClelland, Maier & Neustadt, P.C.

[57] ABSTRACT

A multipatch antenna including radiating patches (2) positioned on a dielectric sheet (1). The patches (2) are capacitively fed by probes (7) ending in the dielectric sheet (1) near the patches (2). By positioning the probes (7) near selected edges of the radiating patches (2), a selected polarization direction of the radiation field can be realized. By positioning several probes (7) near a radiating patch (2), a radiation field with an adjustable polarization direction or a radiation field with an extremely low cross-polarization can be obtained.

12 Claims, 8 Drawing Sheets

MULTIPATCH ANTENNA WITH EASE OF MANUFACTURE AND LARGE BANDWIDTH

BACKGROUND OF THE INVENTION

1. Field of the Invention

The invention relates to a multipatch antenna comprising an array of at least substantially equal radiators, positioned on one side of a dielectric sheet, a conductive ground plane positioned on the other side of the dielectric sheet, feeding means positioned near the ground plane on a side facing away from the dielectric sheet and capacitive coupling means incorporated between the feeding means and the radiators for energizing the radiators.

2. Discussion of the Background

A multipatch antenna of this kind is known from EP-A0.449.492. In this known multipatch antenna every patch consists of two disc-shaped radiators, disposed parallel and spaced apart, and the capacitive coupling is provided with a feed and a disc-shaped top capacity. Moreover a capacitive block is located near the radiator as an additional reactance element. Compound patches of this type are expensive and do not lend themselves for the production of large arrays.

SUMMARY OF THE INVENTION

The present invention has for its object to realise a multipatch antenna that is easy to be constructed and has a large bandwidth. The antenna is characterised in that the radiators each consist of one single radiating patch, positioned on an outer surface of the dielectric sheet and that the capacitive coupling means comprise constant diameter conducting probes, on one side connected to the feeding means and on the other side ending in the dielectric sheet near a radiating patch, such that these probe ends are completely embedded in the dielectric sheet.

In addition the inventive multipatch antenna can also be excellently modelled due to the simple structure and the predictable behaviour of the radiating patches. This makes the antenna very suitable for applications where the selection of the polarization direction of the radiation pattern is desirable. Selection of the polarization is known per se, for example from the IEE PROCEEDINGS-H, vol 139, no. 5, October 1992, pages 465--471, P. S. Hall, "Dual polarization antenna arrays with sequentially rotated feeding".

According to a first embodiment of the present invention, the antenna is characterised in that the probes end near selected edges of the radiating patches for generating a radiation pattern with a selected polarization direction. The feeding means will mostly be implemented as a transmission-line network, for instance a microstrip network mounted to a second dielectric sheet, which second dielectric sheet is mounted to the ground plane, the microstrip network being mounted on the side facing away from the ground plane.

According to a second very favourable embodiment, the antenna is characterised in that two probes per radiating patch are provided, both ending near two opposed edges of the radiating patch. Energizing the two probes in opposite phases via the transmission line network results in a radiation pattern with a selected polarization direction and a very low cross-polarization.

On account of its uncomplicated construction and the predictable behaviour of the radiating patches, the multipath antenna according to the invention can be conveniently used as a conformal array, for instance as a skin section of an aircraft. In this application, the patches are situated on a curved dielectric sheet which forms an integral part of the fuselage, the feeding means being mounted in the aircraft interior. As known in the art, the feeding means shall be arranged such as to allow for phase differences caused by the curvature of the antenna plane. Also the polarization behaviour of the antenna thus obtained can be excellently modelled due to the predictable behaviour of the radiating patches.

According to a third embodiment, the feeding means comprise a second, separately feedable transmission line network.

In a first application of this embodiment, the multipatch antenna is characterised in that for each radiating patch a first probe is provided for generating a radiation pattern with a first polarization direction and a second probe for generating a radiation pattern with a second polarization direction, which second polarization direction is at least substantially perpendicular to the first polarization direction. By connecting the first probe to the first transmission line network and the second probe to the second transmission line network and by subsequently feeding both networks in a suitable manner, an antenna with an adjustable polarization direction can be obtained.

In a second application of this embodiment, the antenna is characterised in that for each radiating patch, a first pair of probes is provided for generating a radiation pattern with a first polarization direction and a second pair of probes for generating a radiation pattern with a second polarization direction being at least substantially perpendicular to the first polarization direction. The first transmission-line network is then arranged for feeding the first pair of probes with opposite phases and the second transmission-line network is arranged for feeding the second pair of probes with opposite phases. Thus, an antenna with an adjustable polarization direction and a very low cross-polarization is obtained.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
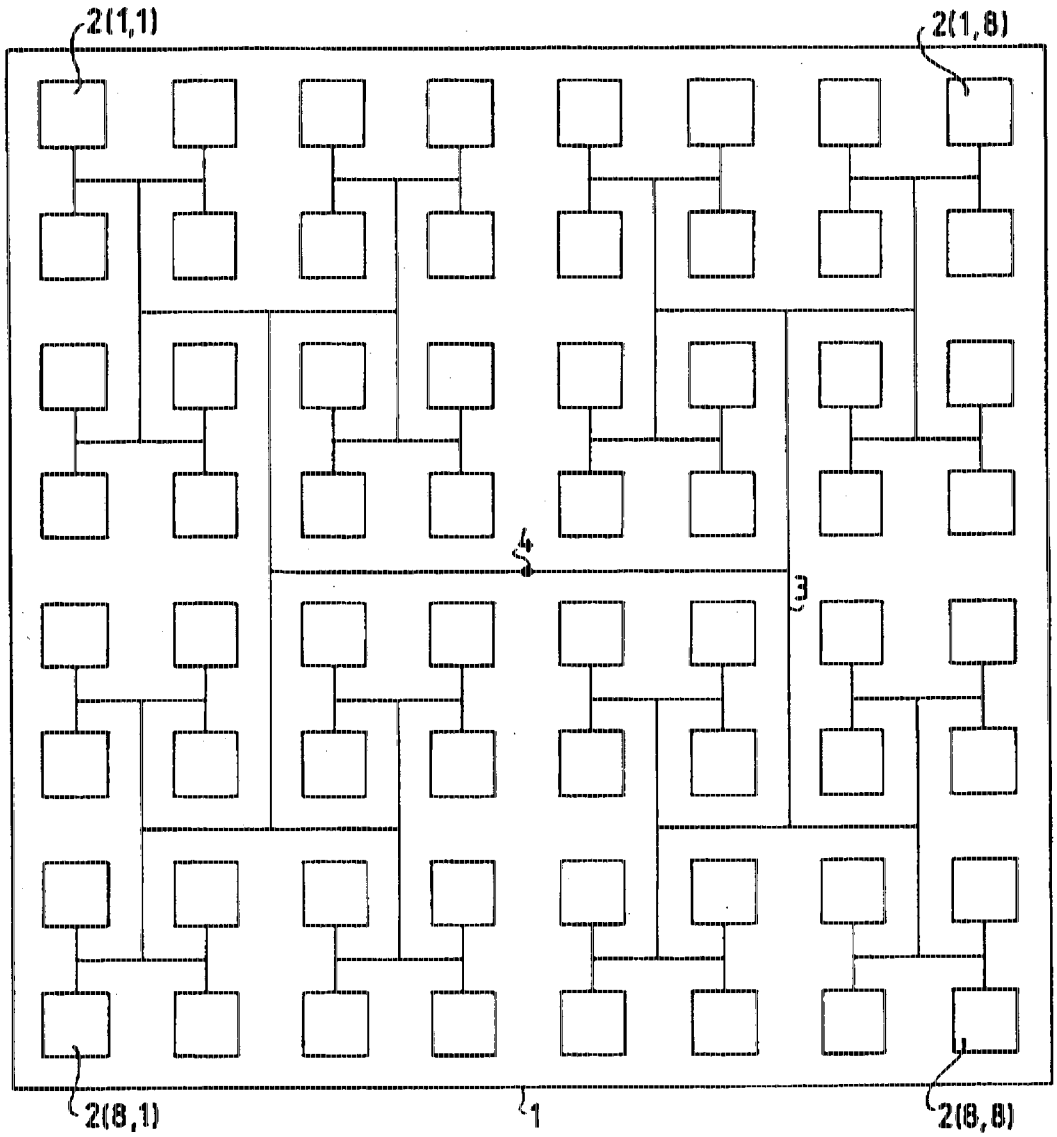
Fig. 1 BACKGROUND ART
FIG. 1 schematically represents a front view of an existing multipatch antenna and a microstrip-line network.

Referring now to the drawings, wherein like reference numerals designate identical or corresponding parts throughout the several views, and more particularly to FIG. 1 thereof, which shows a front view of an existing multi-patch antenna, comprising a dielectric sheet 1 on which radiating patches 2(*i,j*) are mounted in a regular pattern. A transmission-line network 3 connects each radiation patch 2(*i,j*) to an input terminal 4 which, for instance via a coaxial connector not illustrated in the drawing, may be connected to a transmitter device or to a receiver device. Particularly the transmission-line network 3 has been represented in a very simplified manner, since various measures well-known in he art are required to prevent reflections and also to ensure an in-phase drive of all radiating patches 2(*i,j*). The dielectric sheet 1 is generally mounted to a metal plate not visible in the drawing and is made of a material having low dielectric losses. Although FIG. 1 shows a configuration of patches 2(*i,j*) arranged to lie in rows and columns, other configurations are also possible, such as for instance a configuration in which the odd-numbered rows are staggered half a column with respect to the even-numbered rows. This may prevent the occurrence of grating lobes.

Figure 2:
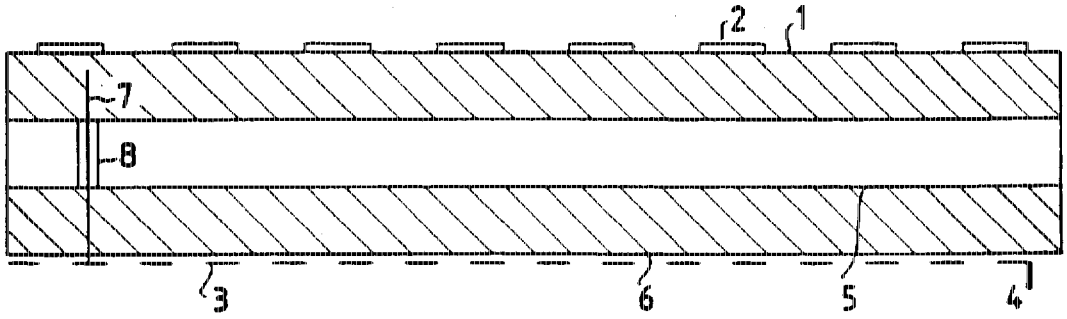
FIG. 2 schematically represents a side view of an embodiment of the multipatch antenna according to the invention together with a microstrip-line network.

FIG. 2 shows a side view of an embodiment of a multi-patch antenna according to the invention. On one side, the dielectric sheet 1 comprises a regular pattern of radiating patches 2(*i,j*) and on the other side it is provided with a metal plate 5. The transmission-line network 3, implemented as a microstrip-line network and provided with an input terminal 4, is, however, now mounted on a second dielectric sheet 6, which is also positioned on metal plate 5. This transmission-line network 3 may be identical to that shown in FIG. 1, although in view of the excess space, its implementation may also differ in detail, such in accordance with design criteria well-known in the art. Connection of the transmission-line network 3 to the radiating patches 2(*i,j*) is, according to the invention, effected by means of probes 7(*i,j*) which are connected on one side to the transmission-line network 3 and end on he other side in the dielectric sheet 1, near radiating patch 2(*i,j*). Thus transmission-line network 3 and radiating patch 2(*i,j*) are coupled capacitively. In order to allow the passage of probe 7(*i,j*), metal plate 5 is, where necessary, provided with holes 8, the diameters of which are selected in connection with the diameter of the probes 7(*i,j*) so as to minimize microwave radiation reflection.

In the present embodiment the diameter of the probes 7(*i,j*) is 0.8 mm and the diameter of the holes is 1.8 mm. Dielectric sheet 6 is also provided with holes whose diameters correspond with the diameters of probes 7(*i,j*). These holes may be partially metal-plated to effect a reliable connection or to obtain improved microwave characteristics. In addition, the holes will often be surrounded by short-circuit pins to effect a proper coupling of the microwave energy in conducting probe 7(*i,j*). Dielectric sheet 1 is provided with blind holes, whose diameters correspond with the diameters of probes 7(*i,j*). In the present embodiment pertaining to an antenna operating in the 10 GHz frequency range, the thickness of the dielectric sheet 1 is 4.2 mm, probe 7(*i,j*) ending at 0.17 mm from radiating patch 2(*i,j*). Dielectric sheet 1 may for instance be made of Duroid, a material well-known in the art, which has a relative dielectric constant of 2.5. If so required, dielectric sheet 1 may comprise a sandwich consisting of two sheets, the first of which is drilled through to allow the passage of probes 7(*i,j*) and the second of which is not drilled for obtaining the specified distance between probes 7(*i,j*) and radiating patches 2(*i,j*).

In another embodiment the diameter of the probe 7(*i,j*) is 1.27 mm and the diameter of the hole is 4.2 mm, the thickness of the dielectric sheet 1 is 6.61 mm and the probe 7(*i,j*) ends at 0.25 mm from radiating patch 2(*i,j*).

The patch is rectangular with sides of 11.5 mm. The probe ends just underneath an edge of the patch, 1.15 mm away from a corner. This embodiment has at a centre frequency of 7 GHz a −10dB bandwidth of 3.3 GHz.

Instead of a microstrip network on a dielectric sheet, transmission-line network 3 may also consist of a sandwich of two dielectric sheets, clamped between two metal plates, the actual transmission line being positioned between the dielectric sheets. This construction, which is well-known in the art, is more complex, but produces a network with lower radiation losses.

For some applications it is recommendable to cover the patches with an additional dielectric film. Apart from offering a protection against mechanical and chemical influences, this method may provide, at a favourably selected thickness and dielectric constant of the additional dielectric film, an additional increase of the antenna bandwidth.

Figure 2A:
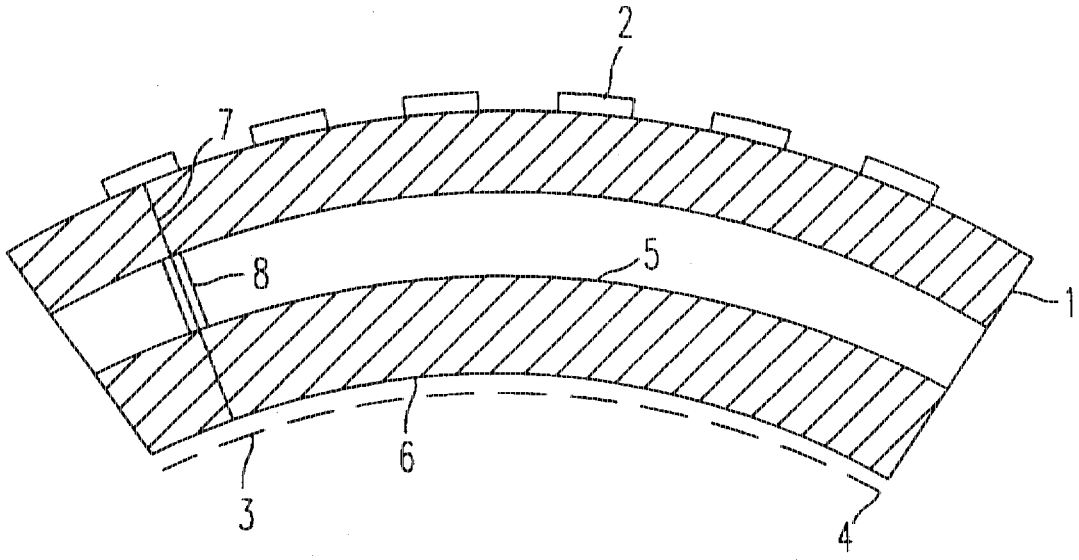
FIG. 2*a* schematically represents a side view of an embodiment of the multipatch antenna according to the present invention wherein the antenna is a conformal array antenna on a curved ground plane.

The antenna may also be configured as a conformal array antenna on a curved ground plane as shown in FIG. 2A.

Figure 3:
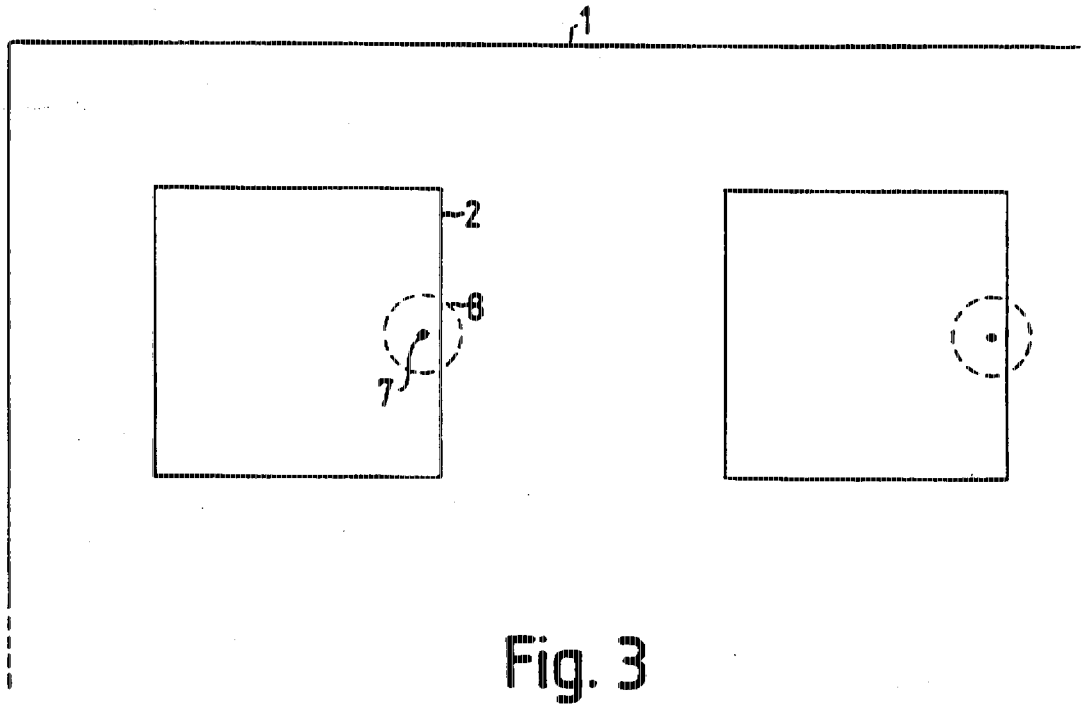
FIG. 3 schematically represents the position of the probes for obtaining a radiation pattern with a horizontal polarization direction.

FIG. 3 schematically presents the position of a probe 7(*i,j*) with respect to the associated radiating patch 2(*i,j*) if an antenna with a horizontal polarization direction is required. By positioning the conducting probe near bet centre of a vertical edge, the patch is excited such that energy is at least substantially radiated in a desired polarization direction. The application of a circular patch is also possible, the conducting probe shall then be positioned accordingly. As a rule, a rectangular patch is more advantageous for horizontal or vertical polarization.

Figure 4:
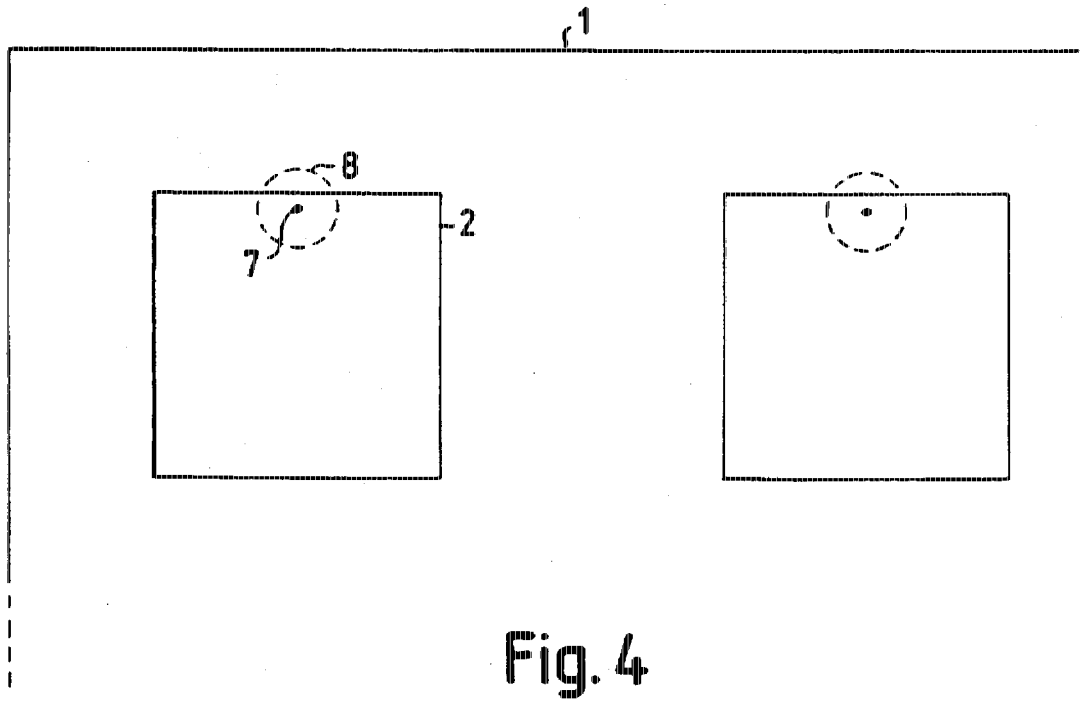
FIG. 4 schematically represents the position of the probes for obtaining a radiation pattern with a vertical polarization direction.

Similarly, FIG. 4 schematically represents the position of probe 7(*i,j*) with respect to the corresponding radiating patch 2(*i,j*) if an antenna with a vertical polarization direction is required. By positioning the conducting probe near the centre of a horizontal edge, the patch is excited such that energy is radiated at least substantially in a desired polarization direction.

Figure 5:
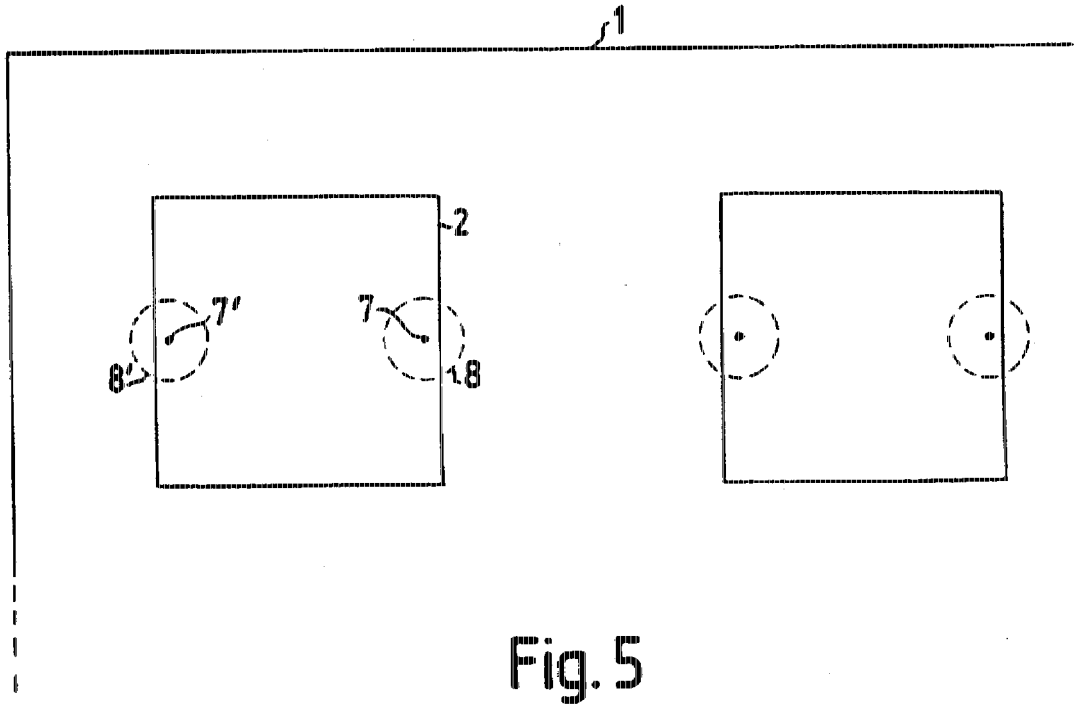
FIG. 5 schematically represents the position of the probes for obtaining a radiation pattern with a horizontal polarization direction and a reduced cross-polarization.

FIG. 5 schematically represents the position of probes 7(*i,j*) and 7'(*i,j*) with respect to the corresponding patch 2(*i,j*) if an antenna with a horizontal polarization direction and an extremely reduced cross-polarization is required. Both vertical edges of the radiating patch 2(*i,j*) are excited in opposite phases via transmission-line network 3, probe 7(*i,j*) and probe 7'(*i,j*).

Figure 6:
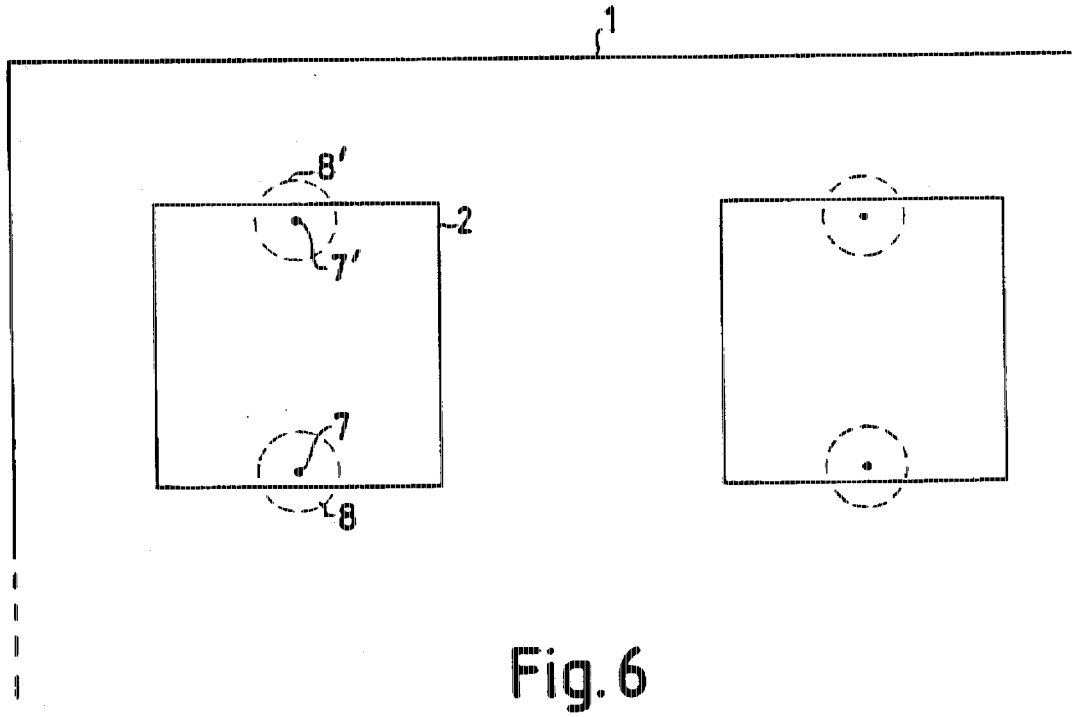
FIG. 6 schematically represents the position of the probes for obtaining a radiation pattern with a vertical polarization direction and a reduced cross-polarization.

FIG. 6 schematically represents the position of probes 7(*i,j*) and 7'(*i,j*) such that a vertical polarization direction with an extremely reduced cross-polarization can be realised analogously.

Figure 7:
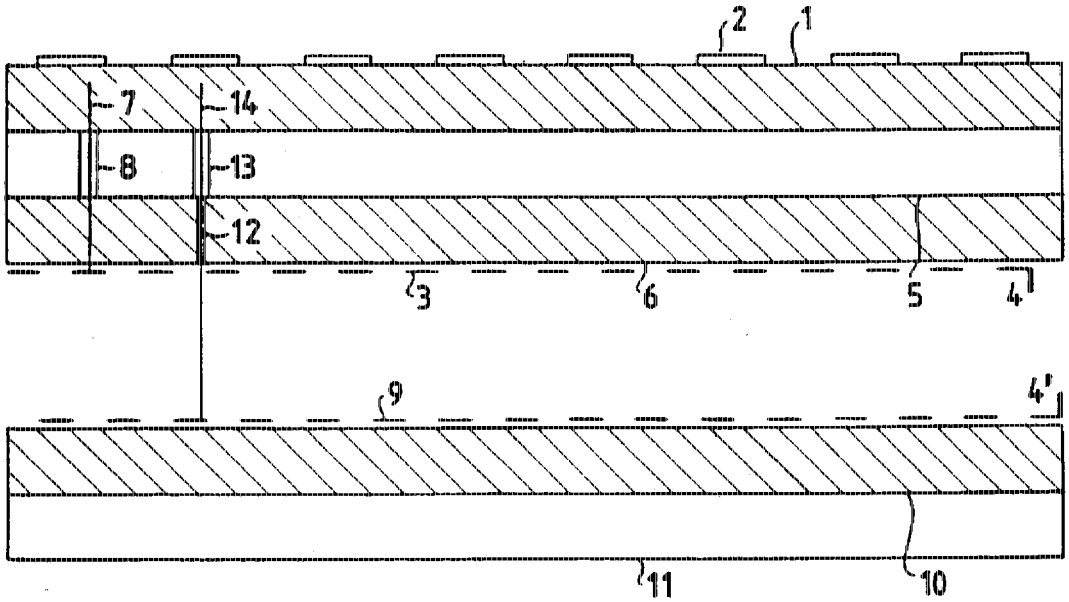
FIG. 7 schematically represents a side view of an embodiment of the multipatch antenna according to the invention together with two microstrip-line networks.

FIG. 7 represents a side view of an embodiment of the multipatch antenna with a second transmission-line network 9 provided with an input terminal 4', implemented as a microstrip network mounted on a second dielectric sheet 10 which is mounted on a second metal sheet 11. Transmission-line network 9 is provided with probes 14(*i,j*) which, via dielectric sheet 6 and metal plate 5, which is for that purpose provided with holes 13(*i,j*), end near radiating patches 2(*i,j*). This enables each radiating patch 2(*i,j*) to be provided with two probes 7(*i,j*), energized by transmission-line network 3 and two probes 14(*i,j*), energized by transmission-line network 9. Also this network 9 can be realised as strips clamped between two dielectric sheets and two metal plates or can be implemented in similar stripline technology.

Figure 8:
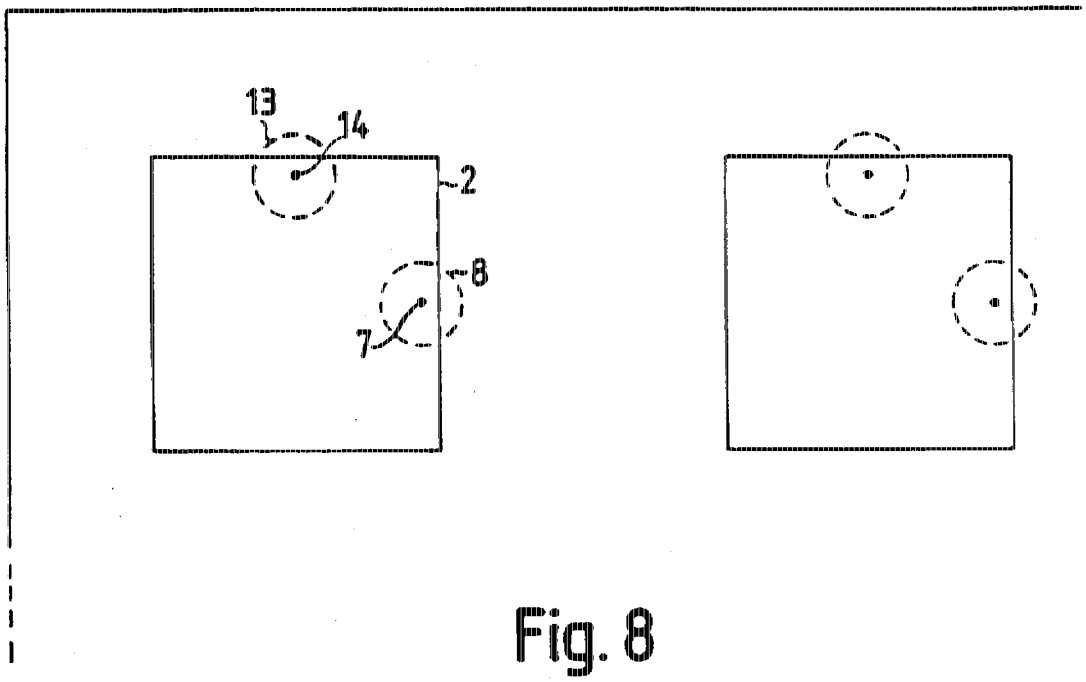
FIG. 8 schematically represents the position of the probes for obtaining a radiation pattern with an adjustable polarization direction.

FIG. 8 schematically represents the position of probes 7(*i,j*) and 14(*i,j*) with respect to corresponding radiating patch 2(*i,j*) if an antenna with an adjustable polarization direction is required. A horizontal polarization direction can be obtained by feeding radiating patch 2(*i,j*) by transmission-line network 3 and probes 7(*i,j*) and a vertical polarization direction can be obtained by transmission-line network 9 and probes 14(*i,j*). As well-known in the art, any required polarization direction can then be realised by controlling the phase and amplitude of the microwave energy to be supplied to the transmission-line networks.

Figure 9:
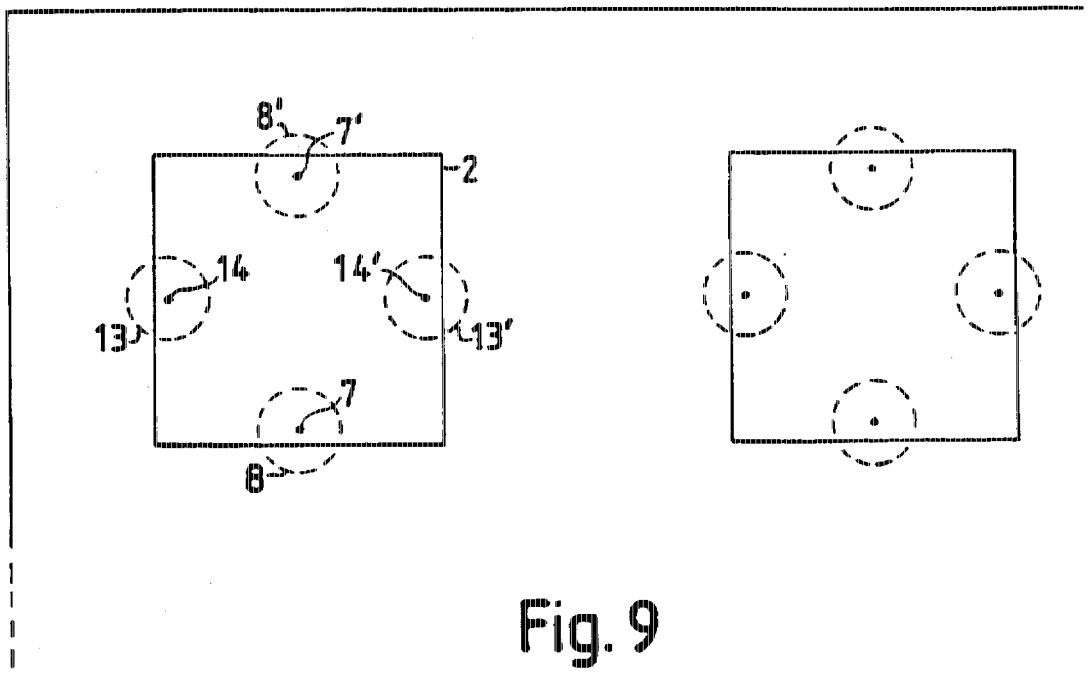
FIG. 9 schematically represents the position of the probes for obtaining a radiation pattern with an adjustable polarization direction and an extremely reduced cross-polarization.

FIG. 9 schematically represents the position of a first pair of probes 7(*i,j*) and 7'(*i,j*) and a second pair of probes 14(*i,j*) and 14'(*i,j*) for obtaining a radiation pattern with an adjustable polarization direction and an extremely reduced cross-polarization. Probes 7(*i,j*) and 7'(*i,j*) are fed through transmission-line network 3 in opposite phases and probes 14(*i,j*) and 14'(*i,j*) are fed through transmission-line network 9 in opposite phases. Also in this case it is possible to realise any desired polarization direction by controlling, in phase and amplitude, the microwave energy supplied to the transmission-line networks, with the additional advantage that cross-polarization is limited by controlling the balanced steering of the pairs of probes.

Figure 10:
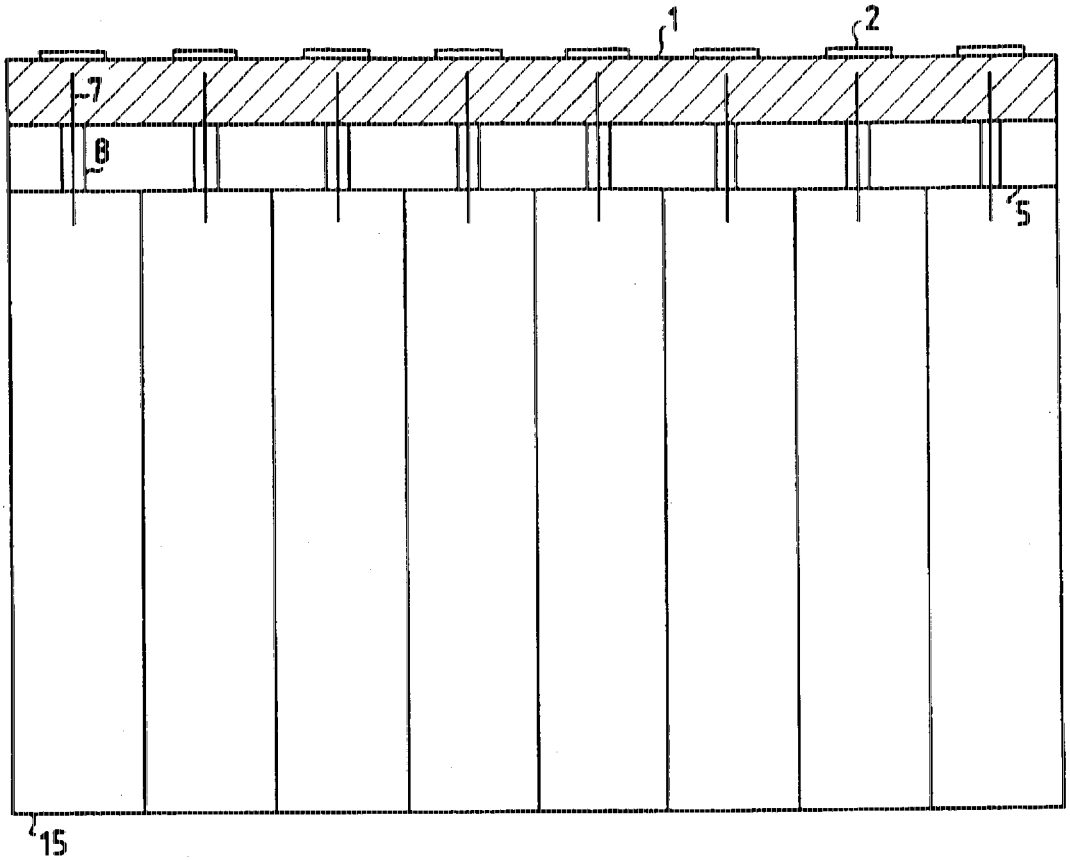
FIG. 10 schematically represents a side view of a multi-patch antenna connected to an array of phased array elements.

The multipatch antenna according to the invention is also preeminently suitable to be incorporated in a phased array antenna. FIG. 10 shows in cross section a dielectric sheet 1 provided with radiating patches 2(*i,j*), a metal plate 5 provided with holes 8(*i,j*) and probes 7(*i,j*). In his application, probes 7(*i,j*) are not fed by a transmission-line network, but from phased array elements 15(*i,j*) which are in turn fed in a way well-known in the art for obtaining a radiation pattern with adjustable beam parameters. Also the connection of a probe 7(*i,j*) to a electric circuit contained in the phased array element is well-known in the art. The present embodiment is preeminently suitable for creating subarrays of for instance 8×8 phased array elements connected to 8×8 radiating patches, each subarray then constituting a module in a phased array antenna system to be realised. Besides the extremely uncomplicated construction, the present embodiment has the advantage of said large bandwidth. In addition it is also possible to provide each phased array element with two probes. By feeding these probes at an adjustable phase and amplitude, an adjustable polarization direction can be obtained, such in accordance with the description pertaining to FIG. 8. By feeding these probes in opposite phase, a polarization direction with a very low cross-polarization can be obtained, such in accordance with the description pertaining to FIG. 5 and FIG. 6.

By means of phased array elements 15(*i,j*) which are suitable for the balanced feeding of two pairs of probes, as described with reference to FIG. 9, it is possible to analogously realise a phased array antenna with an adjustable polarization direction and a very low cross-polarization.

Figure 11:
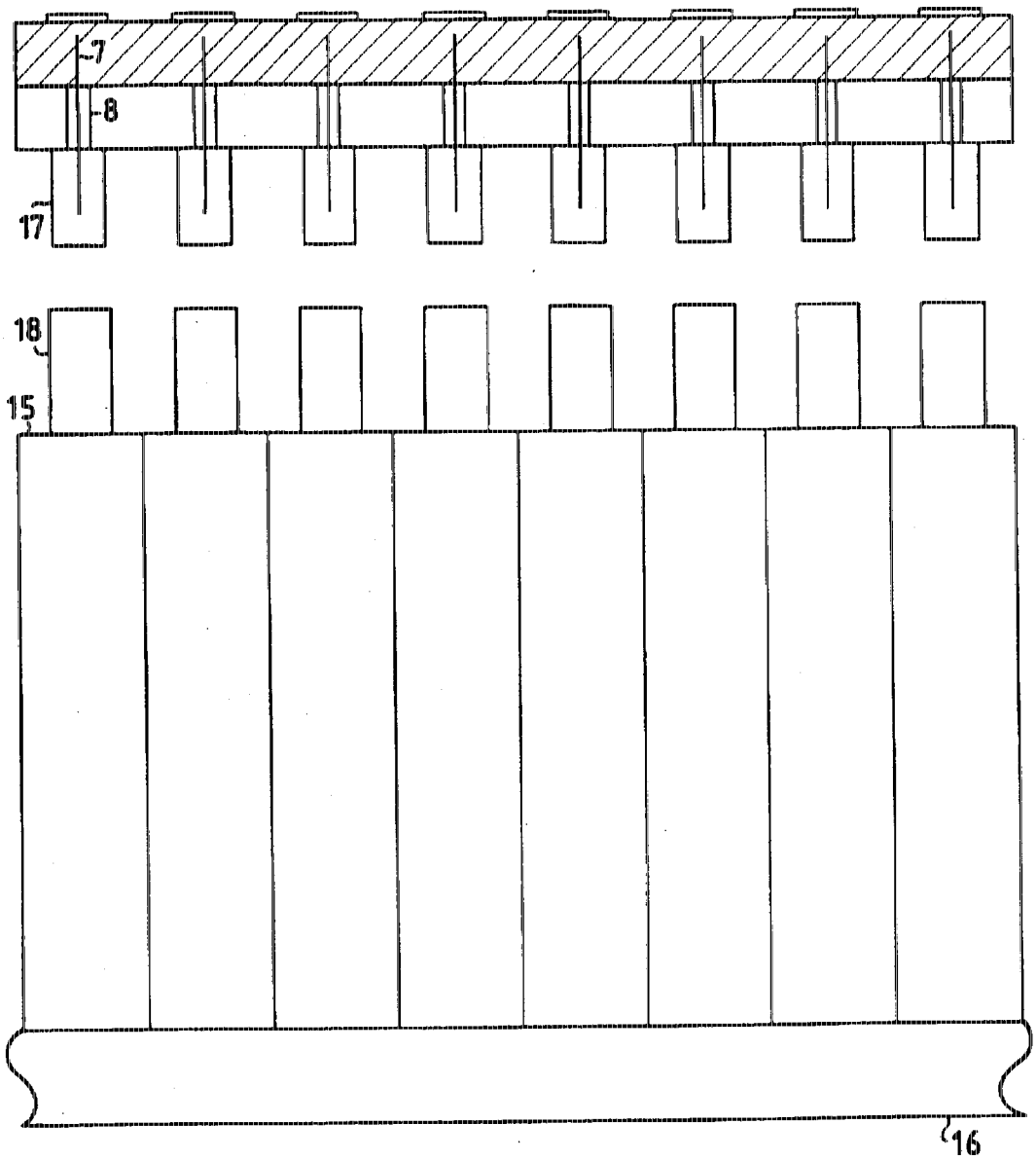
FIG. 11 schematically represents a side view of a multi-patch antenna connected, via connectors, to an array of phased array elements.

Phased array elements 15(*i,j*) will usually be positioned in a backplane 16, via which control signals, supply voltages, transmit-receive signals and cooling are applied to the phased array elements. In this case the multipatch antenna shall be the final item in the assembly process, mounted from the front of the phased array antenna system. FIG. 11 shows a multipatch antenna according to the invention, suitable for front mounting. In this figure, metal plate 5 is provided with connectors 17(*i,j*), one for each probe 7(*i,j*) which is directly connected to the corresponding connector 17(*i,j*). By providing corresponding phased array element 15(*i,j*) with a counterpart 18(*i,j*) to connector 17(*i,j*), it is possible for the multipatch antenna to be he final item in the assembly process. In this respect it is advisable to select self-centring versions of connectors 17(*i,j*) and 18(*i,j*) and to divide the multipatch antenna into subarrays in order to reduce the forces acting during assembly or disassembly of the multipatch antenna.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A multipatch antenna comprising:

an array of at least substantially equal radiators, positioned on one side of a dielectric sheet;

a conductive ground plane positioned on the other side of the dielectric sheet;

feeding means positioned near the ground plane on a side facing away from the dielectric sheet; and capacitive coupling means incorporated between the feeding means and the radiators for energizing the radiators;

wherein the radiators each consist of one single radiating patch, positioned on an outer surface of the dielectric sheet and the capacitive coupling means comprise constant diameter conducting probes, on one side connected to the feeding means and on the other side ending in the dielectric sheet near the radiating patch, such that the ends of the conducting probes are completely embedded in the dielectric sheet.

2. The multipatch antenna as claimed in claim 1, wherein the ground plane is provided with apertures at the location of the radiating patches to allow the passage of the probes.

3. The multipatch antenna as claimed in claim 2, wherein the probes end near selected edges of the radiating patches for generating a radiation pattern with a selected polarization direction.

4. The multipatch antenna as claimed in claim 3, wherein for each radiating patch, two probes are provided, both ending near opposite edges of the radiating patch.

5. The multipatch antenna as claimed in claim 4, wherein the feeding means are arranged for feeding the two probes in opposite phases.

6. The multipatch antenna as claimed in claim 5, wherein the antenna comprises a conformal array on a curved ground plane.

7. The multipatch antenna as claimed in claim 4, wherein the antenna comprises a conformal array on a curved ground plane.

8. The multipatch antenna as claimed in claim 3, wherein the antenna comprises a conformal array on a curved ground plane.

9. The multipatch antenna as claimed in claim 3, wherein for each radiating patch, a first probe is provided for generating a radiation pattern with a first polarization direction and a second probe is provided for generating a second polarization direction which is at least substantially perpendicular to the first polarization direction.

10. The multipatch antenna as claimed in claim 3, wherein for each radiating patch, a first pair of probes is provided for generating a radiation pattern with a first polarization direction and a second pair of probes is provided for generating a radiation pattern with a second polarization direction, the second polarization direction being at least substantially perpendicular to the first polarization direction.

11. The multipatch antenna as claimed in claim 2, wherein the antenna comprises a conformal array on a curved ground plane.

12. The multipatch antenna as claimed in claim 1 wherein the antenna comprises a conformal array on a curved ground plane.

* * * * *